United States Patent [19]

Cowell

[11] 4,196,478

[45] Apr. 8, 1980

[54] PORTABLE SHAMPOO TRAY

[76] Inventor: Richard J. Cowell, 3 Hoffman Rd., High Bridge, N.J. 08829

[21] Appl. No.: 877,320

[22] Filed: Feb. 13, 1978

[51] Int. Cl.[2] ..... A47K 3/12

[52] U.S. Cl. ..... 4/159; 4/185 HB

[58] Field of Search ..... 4/159, 185 HB, 167, 4/185 B, 185 R; 248/27.5

[56] References Cited

U.S. PATENT DOCUMENTS

| | | | |
|---|---|---|---|
| 318,368 | 5/1885 | Gitt | 4/185 HB |
| 585,005 | 6/1897 | Price | 248/27.5 |
| 1,223,263 | 4/1917 | Day | 4/159 |
| 2,163,755 | 6/1939 | Labruzzo | 4/159 |
| 2,200,247 | 5/1940 | Haas | 4/185 HB |
| 4,024,590 | 5/1977 | Wendt | 4/167 |

*Primary Examiner*—Lenard A. Footland

*Attorney, Agent, or Firm*—Robert D. Farkas

[57] ABSTRACT

A portable shampoo tray utilizes a body supporting sheet having a notch therein adapted to receive the neck of the user. The sheet is pivotably secured to a pair of arms, each having suction cups fastened to the lowermost surfaces thereof. A pair of struts are pivotably secured to the arms having their uppermost ends disposed in one of a plurality of socket-like cavities disposed along the marginal edges of the supporting sheet. An open mouth container is secured to the marginal edge of the supporting sheet for receiving articles utilized in a hair shampooing operation. The apparatus may be folded up such that the arms and the struts form a package when not in use.

7 Claims, 3 Drawing Figures

PORTABLE SHAMPOO TRAY

BACKGROUND OF THE INVENTION

1. The Field of the Invention

This invention relates to hair care devices and more particularly to that class of apparatus utilized to support the upper portions of the torso of a user at adjustable angles during a hair shampooing operation.

2. Description of the Prior Art

The prior art abounds with body supporting apparatus useful during a hair care process. Typical of these are the teachings contained in U.S. Pat. No. 3,244,387 issued on Apr. 5, 1966 to J. M. Hargraves et al. This disclosure teaches a convoluted sheet metal structure adapted to support a shampoo tray by clamping to the uppermost marginal edge defining a sink cavity. The supporting structure is provided with an S-shaped cross-sectional having a hook at one end adapted to grasp the lowermost portion of a shampoo tray. Such a device is useful in supporting the shampoo tray at a fixed angle relative to the plane defining the open mouth portion of the sink. Another embodiment of the present invention teaches a sheet-like apparatus having a plurality of hinge-like joints such that the shampoo tray may be located at any desired angle when supported by a sink structure. In each embodiment, the Hargraves apparatus forces the tray to be supported by a sink structure and provides an apparatus which when folded up takes considerable bulk when combined with the bulk of the shampoo tray.

U.S. Pat. No. 3,694,826 issued on Oct. 3, 1972 to M. A. Pugh discloses a portable shampooing unit for washing the hair of bedridden patients wherein the shampooing unit is a substantially self-contained unit requiring only the provision of common electrical house power while in use. The unit comprises a portable cart having a shampoo bowl in communication with a water source and a waste water container and a water heating unit for the water source. The entire unit is particularly designed and constructed to be rolled to the bedside and used for washing the patient's hair while the patient is in bed. The Pugh apparatus utilizes a shampoo tray, having a pair of legs affixed thereto such that the tray is always maintained at a fixed angle. Through the Pugh teaching facilitates the tray being mounted on the surface of the patient's bed, the patient is always forced to reside at a given angle while resting on the tray. Furthermore, the tray portion of this disclosure is not collapsible, occupying a significant amount of space when not in use.

SUMMARY OF THE INVENTION

A primary object of the present invention is to provide an angularly adjustable shampoo tray which may be collapsed when not in use, occupying a minimum amount of space.

Another object of the present invention is to provide a shampoo tray which is portable and lightweight.

Still another object of the present invention is to provide a shampoo tray having an accessory container affixed thereto, conveniently located to the uppermost surface of the tray facilitating the storage of shampoo articles.

Yet another object of the present invention is to provide a shampoo tray which may be secured to relatively slippery surfaces, such as sink tops, tables and the like.

Another object of the present invention is to provide a shampoo tray which is economical to produce, requiring a minimum of maintenance, having a minimum number of parts and durable in nature.

Heretofore, shampoo trays were adapted so as to basically provide a supporting surface for the upper posterior portions of the human torso including a notch at the uppermost edge thereof adapted to receive the occipital regions of the user's head such that hair may extent downwardly past the tray so as to expose same for washing, combining, cutting and treating processes. Such trays were either fabricated to force the user to reside at a fixed angle relative to a supporting surface or to provide a shampoo tray which in turn was required to be supported by a particular type of supporting apparatus, such as a sink or the like. Obviously, such devices have limited utility and are generally uncomfortable to use. The present invention recognizes these limitations and not only overcomes them, but also provides an article storage container attached to a marginal edge of the tray so that articles utilized in the hair treating operation, such as shampooing, may be made relatively easily available to an operator who is treating or working on the user's hair. The present invention further facilitates the storage capabilities and the ease of portability problems encountered in the prior art apparatuses by permitting the element of the tray to be folded up into a neat, lightweight and compact unitary packing during storage and transportation.

These objects as well as other objects of the present invention will become more readily apparent after reading the following description of the accompanying drawings.

DESCRIPTION OF THE PREFERRED EMBODIMENT

Figure 1:
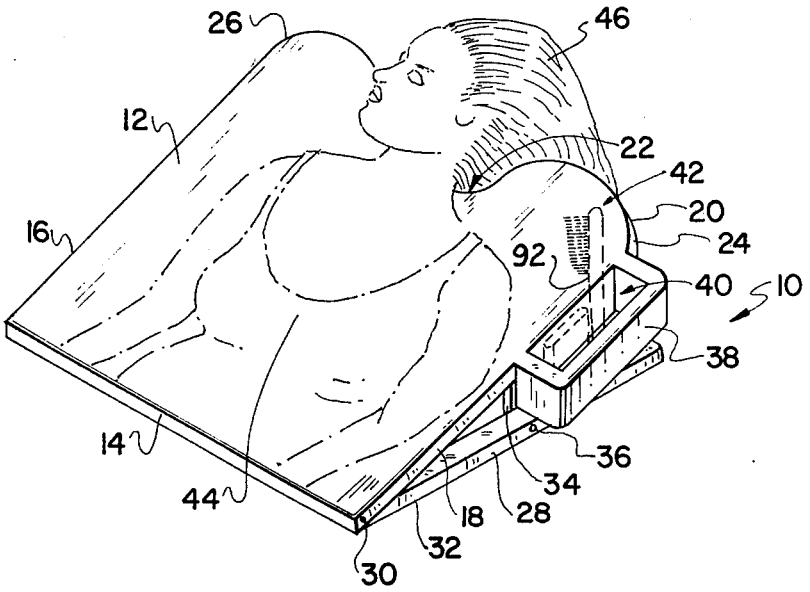
FIG. 1 is a perspective view of the present invention, shown in use position.

The structure and method of fabrication of the present invention is applicable to a shampoo tray utilizing a substantially flat torso supporting sheet, generally having a rectangular shape and including one edge thereof defining an inwardly directed notch of sufficient size to accept the occipital region of the cranium therein. An adjacent side to the side having the notch is provided with a container secured thereto such that the container has an open mouth region extending substantially parallel to and contiguous with the uppermost lateral surface of the body supporting sheet. The floor of the container may be provided with a plurality of drainage holes therein facilitating any trapped water draining outwardly from the container. The container may be compartmentalized so as to more readily separate articles stored therewithin. The side opposite the side having the notch is pivotably secured to a pair of arms, each having one end thereof pivoted about a common line adjacent to the aforementioned side such that each arm has a length somewhat less than the length of the side parallel to the longitudinal axis of the arm. A pair of struts are pivotably secured to the arms and are adapted to have the free ends thereof manually located in one of a plurality of open mouth cavities disposed adjacent to and parallel with the marginal edges of the body support sheet that are parallel to the longitudinal axis of the arms. In use, the arms are disposed parallel to a supporting surface, having a pair of suction cups disposed along the lowermost surface of the arms engaging the supporting surface so as to prevent accidental moving of the arms and hence slippage of the entire apparatus relative to the supporting surface. The struts are disposed in a generally upward direction from the supporting surface having their free ends located within a pair of the cavities, thus disposing the body supporting sheet at any preferred angle relative to the supporting surface. A user is thus permitted to rest upon the shampoo tray having the edge adjacent to the axle rod carrying the arms disposed athwart the body of the user and adjacent the mid-back region thereof. The rear of the head of the user is located within the notch on the opposite edge of the body supporting sheet. The storage container is then located adjacent the upper arm region on one side of the body of the user. A small hole is located in opposed marginal edges of the body supporting sheet on the sides thereof adjacent to the side carrying the head receiving notch. Similar holes are located in the supporting arm. A pair of removable split pins are caused to reside in each of the pair of aligned holes, when the arms are pivoted so as to reside parallel to the plane of the body supporting sheet, thereby causing the assembly to occupy a minimum of space when not in use.

The entire apparatus may be fabricated from a rigid plastic material, such as polypropylene or the like. The suction cups, secured to a lowermost surface of the pair of arms, may be fabricated from a rubber-like material.

Now referring to the figures, and more particularly to the embodiment illustrated in FIG. 1 showing the present invention 10 having an uppermost body supporting sheet 12 including marginal edges 14, 16 18 and 20. Edge 20 is shown having a head receiving notch 22 disposed intermediate curved regions 24 and 26. Supporting arm 28 is shown pivotably secured to sheet 12 utilizing axle rod 30 therefor adjacent marginal edge 14 and secured to end 32 of arm 28. Strut 34 is shown extending upwardly from arm 28 and is pivotably secured thereto utilizing axle 36 therefor. Container 38 is shown having open mouth portion 40 thereof located in the same plane as uppermost lateral surface 42 of sheet 12. Articles 92 are shown stored within container 38. Lowermost edge 40, is disposed downwardly from uppermost edge 20 by the angular location of strut 28. The back portions, not shown, of user 44 are disposed resting upon surface 42 of sheet 12, whilst portions of head 46 of the user are shown residing in notch 22.

Figure 2:
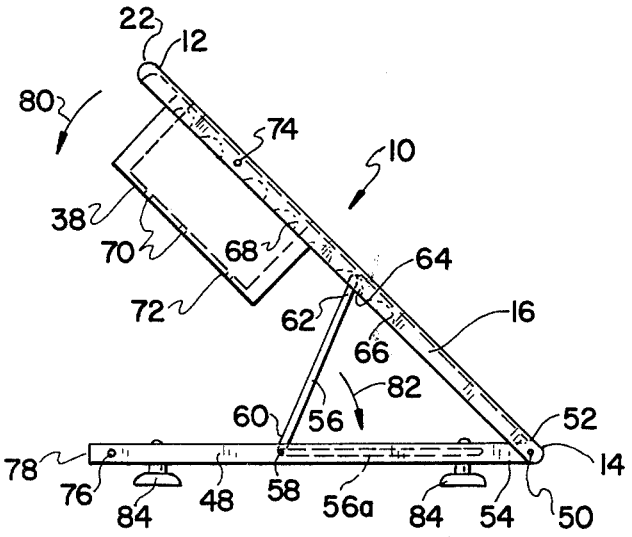
FIG. 2 is a side elevation view of the present invention.

FIG. 2 illustrates sheet 12 shown having marginal edge 22 thereof disposed upwardly from marginal edge 14. Arm 48, a companion to arm 28, shown in FIG. 1, is shown secured to sheet 12 utilizing pivot rod 50. Pivot rod 50 is shown passing through region 52 of supporting sheet 12 and end 54 of supporting arm 48. Strut 56 is shown pivotably secured to arm 48, utilizing axle 58 therefor. Axle 58 passes through end 60 of strut 56 and arm 48. Strut 56 is a companion to strut 34, shown in FIG. 1, as is axle 58, a companion to axle 36, also shown in FIG. 1. The uppermost end 62 of strut 56 is shown disposed located in cavity 64 located along marginal edge 16 of sheet 12. Cavities 66 and 68, may also be utilized so as to dispose the uppermost marginal edge 22 of sheet 12 at any perferred location above the plane in which arm 48 resides. Container 38 is shown affixed to sheet 12 having drainage holes 70 located in base 72 thereof. Hole 74 is located along marginal edge 16 of sheet 12. Hole 76 is located adjacent end 78 of arm 48. A pin, not shown, is caused to reside in holes 74 and 76 when marginal edge is displaced in the direction of arrow 80 so as to collapse supporting sheet 12 into the plane occupied by arm 48. The pin locks together arm 48 and sheet 12 when strut 56 is disposed in the direction of arrow 82 causing strut 56 to occupy the position shown by dotted lines **56*a*. Suction cups 84 are shown secured to arm 48 providing a gripping surface below present invention 10**.

Figure 3:
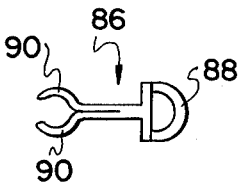
FIG. 3 is a side elevation view of a removable fastener utilized to secure the present invention in locked, non-use position.

FIG. 3 illustrates a split gripping pin 86, adapted for insertion in holes 74 and 76, shown in FIG. 1. Handle portion 88 facilitates easy removal of pin 86 in these holes, when desired. Outwardly fluted ends 90 prevent accidental removal of pin 86 from holes 74 and 76.

One of the advantages of the present invention is to provide an angularly adjustable shampoo tray which may be collapsed when not in use, occupying a minimum amount of space.

Another advantage of the present invention is to provide a shampoo tray which is portable and lightweight.

Still another advantage of the present invention is to provide a shampoo tray which may be secured to relatively slippery surfaces, such as sink tops, tables and the like.

Another advantage of the present invention is to provide a shampoo tray which is economical to produce, requiring a minimum of maintenance, having a minimum number of parts and durable in nature.

Thus, there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows.

I claim:

1. A portable shampoo tray comprising a body supporting sheet, said sheet having a first marginal edge and a second marginal edge and a third marginal edge and a fourth marginal edge, said first and said third marginal edges being disposed in spaced apart relationship, said second and said fourth marginal edges being disposed in spaced apart parallel relationship and substantially perpendicular to said first marginal edge, a container, said container being fixedly secured to said fourth marginal edge, said container having an open mouth portion, a pair of arms, one end of each of said pair of arms pivotably secured to said second and said fourth marginal edges, a pair of struts, one end of each of said pair of struts pivotably secured to said pair of arms, a plurality of open mouth cavities disposed along a lateral surface of said sheet adjacent and parallel to said second and said fourth marginal edges, the other end of said pair of struts being disposed located in a pair of said open mouth cavities.

2. The apparatus as claimed in claim 1 wherein said open mouth portion of said container resides in a plane defined by a lateral surface of said body supporting sheet.

3. The apparatus as claimed in claim 1 further comprising at least a pair of suction cups, said at least a pair of suction cups fixedly secured to each of said pair of arms.

4. The apparatus as claimed in claim 1 further comprising said container having a plurality of holes located in the base portion of said container.

5. The apparatus as claimed in claim 1 further comprising a pair of holes, one of said pair of holes, being located in said second marginal edge, the other of said pair of holes being located in said fourth marginal edge, another pair of holes, one of said another pair of holes being disposed located in the other end of said each of said pair of arms, said pair of holes and said another pair of holes being disposed coaxially aligned when said pair of arms and said body supporting sheet are located folded into a common plane.

6. The apparatus as claimed in claim 5 further comprising a pin, said pin being disposed passing through said one of said pair of holes and one of said another pair of holes when said pair of arms are disposed folded up residing parallel to said plane.

7. The apparatus as claimed in claim 1 wherein said body supporting sheet comprises polypropylene.

* * * * *